US007281967B2

(12) United States Patent
Meunier et al.

(10) Patent No.: US 7,281,967 B2
(45) Date of Patent: Oct. 16, 2007

(54) MACHINE FOR GRINDING OPTICAL LENSES

(75) Inventors: Jean-Marc Meunier, Oissel (FR); Laurent Sroka, Val de la Haye (FR)

(73) Assignee: Briot International, Pont de L'Arche (FR)

( * ) Notice: Subject to any disclaimer, the term of this patent is extended or adjusted under 35 U.S.C. 154(b) by 71 days.

(21) Appl. No.: 10/549,897

(22) PCT Filed: Mar. 25, 2004

(86) PCT No.: PCT/FR2004/000754

§ 371 (c)(1),
(2), (4) Date: Sep. 20, 2005

(87) PCT Pub. No.: WO2004/087374

PCT Pub. Date: Oct. 14, 2004

(65) Prior Publication Data

US 2006/0217036 A1 Sep. 28, 2006

(30) Foreign Application Priority Data

Mar. 27, 2003 (FR) ..... 03 03792

(51) Int. Cl.
*B24B 49/00* (2006.01)
*B24B 9/14* (2006.01)

(52) U.S. Cl. ..... 451/5; 451/255; 451/323; 451/325

(58) Field of Classification Search ..... 451/5, 451/11, 42, 43, 44, 255, 256, 323, 325
See application file for complete search history.

(56) References Cited

U.S. PATENT DOCUMENTS

| | | | | |
|---|---|---|---|---|
| 5,056,270 | A | 10/1991 | Curcher | |
| 5,964,647 | A | 10/1999 | Henky | |
| 6,497,614 | B2 * | 12/2002 | Kobayashi et al. | 451/43 |
| 6,796,878 | B2 * | 9/2004 | Mitsuzono et al. | 451/5 |

FOREIGN PATENT DOCUMENTS

| | | |
|---|---|---|
| DE | 100 13 649 | 9/2001 |
| EP | 0 350 216 A2 | 1/1990 |

* cited by examiner

*Primary Examiner*—Jacob K. Ackun, Jr.
(74) *Attorney, Agent, or Firm*—Wenderoth, Lind & Ponack, L.L.P.

(57) ABSTRACT

The invention relates to a machine comprising a train of grinding stones (21), mounted to rotate about a first axis (A–A'), a lens support (15), provided with means (37), for rotating the lens (35) about a second axis (B–B') parallel to the first axis (A–A'), means (13, 39) for relative radial and axial positioning of the lens support (15) with relation to the train of grinding (21) and a tool carrier unit (17) with a tool (81; 83; 85) fixed to a tool support shaft (75) rotating about a third axis (C–C'). In an active position the tool is adjacent to the second axis (B–B') and the third axis (C–C') with a variable angle with relation to the second axis (B–B'). The tool support unit (17) further comprises means (79) for controlling the angle of inclination of the third axis (C–C') with relation to the second axis (B–B'), when the tool (81, 83, 85) is at a distance from the lens (35). Of application to the grinding of ophthalmic lenses.

20 Claims, 5 Drawing Sheets

MACHINE FOR GRINDING OPTICAL LENSES

BACKGROUND OF THE INVENTION

The present invention relates to a machine for grinding optical lenses.

Known machines (EP 0 350 216) are used to carry out economically and efficiently back-beveling operations to grind down the sharp edges of an ophthalmic lens blank after it has been ground.

Such machines are not entirely satisfactory. Specifically, the extent of the surface machined by the back-beveling grindstone depends on the curvature of the lens. During the back-beveling operation and in the case of greatly curved lenses, the back-beveling grindstone is in contact with the lens over a greater surface area than in the case of flat or virtually flat lenses. The quality of the back-beveling and consequently the appearance of the lens obtained therefore vary depending on the curvature of the lens.

Furthermore, the machines of the aforementioned type (see for example JP 8 155 945) are used more precisely to carry out operations of grooving and/or drilling the lens, but are bulky.

The main object of the invention is to remedy these disadvantages, that is to say to provide a machine that can be used to simply back-bevel, groove and/or drill optical lenses with a constant quality of operation irrespective of the curvature of the lens, and that is not very bulky.

SUMMARY OF THE INVENTION

Accordingly, the subject of the invention is a grinding machine of the aforementioned type, characterized in that the control means are suitable for retracting the tool-carrier shaft via the control of the angle of inclination.

Furthermore, to carry out the operations of back-beveling, grooving and drilling, the known machines of the aforementioned type require complex mechanisms to move the tool-carrier assembly relative to the lens support.

Another object of the invention is to obtain a grinding machine of the aforementioned type whose structure is simplified.

As a result, according to another aspect of the invention, the machine of the aforementioned type comprises means for relative movement of the tool-carrier shaft relative to the lens support in translation along the third axis when the tool is in the active position. Further, the means for relative movement comprise means for relative translation of the tool-carrier shaft relative to the second axis in a first direction, parallel to the second axis, means for pseudo-translation of the lens support relative to the second axis in a second direction perpendicular to the second axis, and means for synchronizing the translation and pseudo-translation means.

BRIEF DESCRIPTION OF THE DRAWINGS

An exemplary embodiment of the invention will now be described with regard to the appended drawings in which.

DETAILED DESCRIPTION OF PREFERRED EMBODIMENTS

Figure 1:
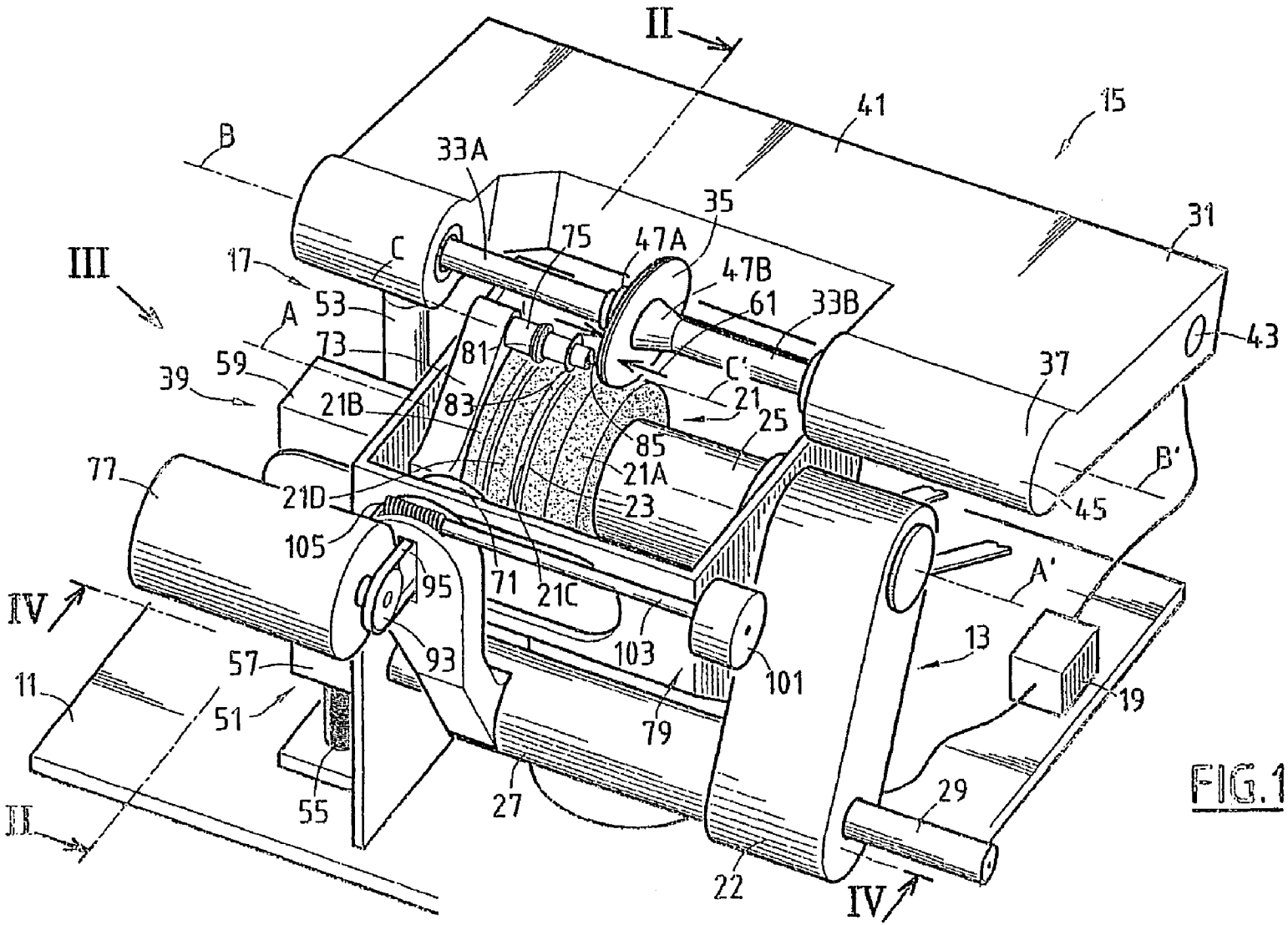
FIG. 1 is a partial three-quarter top view in perspective of the pertinent portions of a grinding machine according to the invention.

The grinding machine represented in FIGS. 1 to 5 is intended to produce a beveled and back-beveled optical lens, and carry out grooving and drilling operations based on a generally circular lens blank.

This grinding machine comprises a frame 11, a grinding assembly 13, a lens support 15, a tool-carrier assembly 17 and a control unit 19.

The grinding assembly 13 comprises a grindstone set 21 mounted rotatably about a first horizontal axis A–A' in a grindstone support 22 and rotated by a grinding motor (not shown).

The grindstone set 21 consists of several juxtaposed grindstones 21A to 21D. The grindstones are associated with a type of lens to be ground and with various steps of the grinding process: a grindstone 21A for rough-cutting mineral lenses, a grindstone 21B for rough-cutting synthetic lenses, a finishing grindstone with beveling 21C provided with a circular groove 23, and a grindstone 21D for polishing with beveling. This grindstone set 21 may where necessary be fitted with finishing or polishing grindstones without beveling.

This grindstone set 21 is fixedly mounted on a grindstone shaft 25, itself mounted freely rotatable in the support 22 about the first axis A–A'.

The bottom portion 27 of the grindstone support 22 is mounted slidingly in an axial direction parallel to the first axis A–A' on a sliding bar 29. Means (not shown) are used to drive the grinding assembly 13 in translation in this axial direction by sliding the grindstone support 22 along the sliding bar 29.

The lens support 15 comprises a carriage 31 mounted tiltably on the frame 11 and furnished with two half-shafts 33A and 33B suitable for gripping the lens blank 35, a motor 37 for rotating the lens blank 35, and means 39 for radially positioning the carriage 31 relative to the first axis A–A'.

The carriage is articulated by one longitudinal edge 41 about a tilt shaft 43 disposed parallel to the first axis A–A'.

The two half-shafts 33A and 33B are mounted along the other longitudinal edge 45 of the carriage 31. These half-shafts 33A and 33B are disposed on a second horizontal axis B–B' which, during grinding, is parallel to the first axis A–A'. Furthermore, these half-shafts 33A and 33B are furnished with free ends 47A and 47B facing one another, suitable for gripping the lens blank 35.

The drive motor 37 of the lens blank 35 rotates the half-shaft 33B and the half-shaft 33A about the second axis B–B' via a transmission mechanism (not shown).

Figure 4:
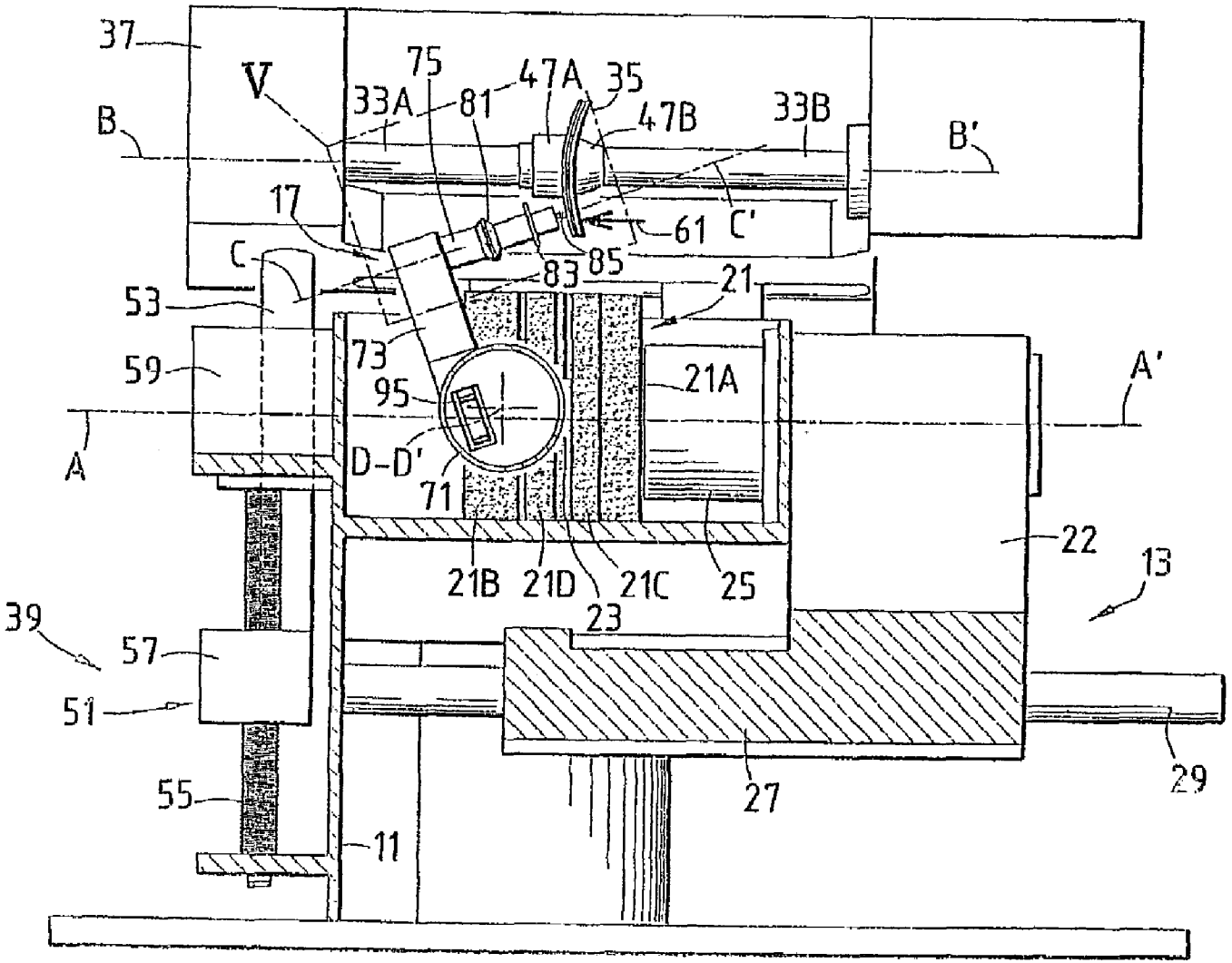
FIG. 4 is a partial view in section along the line IV—IV of FIG. 1 of the grinding machine according to the invention during a drilling operation.

As illustrated in FIG. 4, the radial means 39 of positioning the carriage 31 relative to the first axis A–A' comprise a drive mechanism 51 and a guide rod or button 53.

The drive mechanism 51 comprises a drive worm 55 in interaction with a nut 57. The worm 55 is mounted rotatably on the frame 11 and disposed in a radial direction perpendicular to the axial direction. In the example illustrated in FIG. 2, the drive worm 55 is vertical.

This drive worm 55 is rotated by a motor 59 integral with the frame 11.

Furthermore, the bottom end of the actuation rod 53 is attached to the nut 57. The edge 45 of the carriage 35 adjacent to the second horizontal axis B–B' is resting on the top end of this rod 55.

When the motor 59 rotates the drive worm 55, the nut 57 and the actuation rod 53 move in translation in the vertical direction. The action of the rod 53 on the carriage 31 is used to move the second axis B–B' relative to the first axis A–A' by tilting the carriage 31. For tilting movements of small amplitude, the movement of the second axis B–B' relative to the first axis A–A' can be likened to a vertical pseudo-translation movement. Furthermore, the carriage 31 is furnished with tracers 61 of the lens blank 35, connected to the control unit 19.

Figure 2:
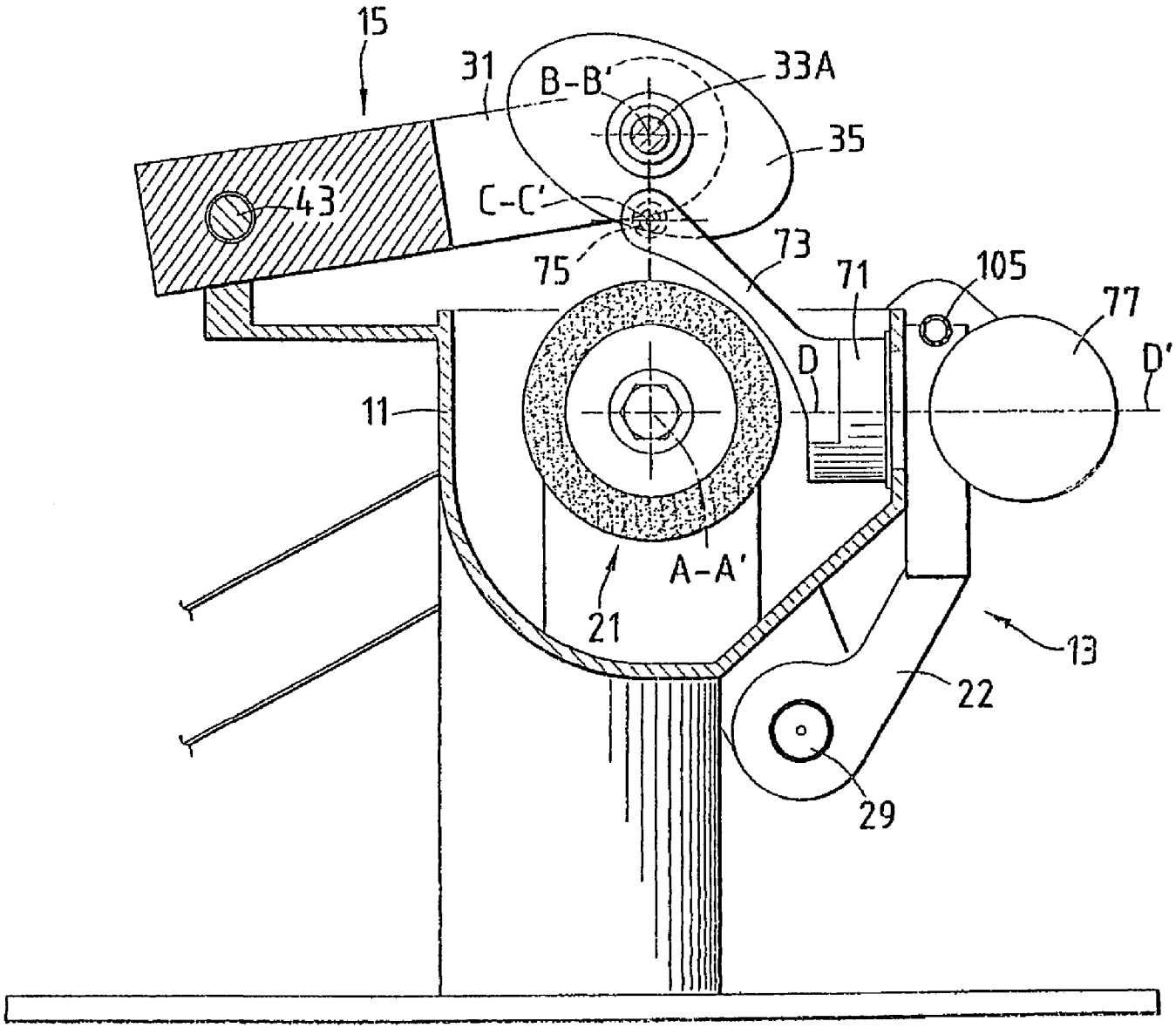
FIG. 2 is a view in partial section along the line II—II of FIG. 1.

With reference to FIGS. 1, 2 and 4, the tool-carrier assembly 17 comprises a support 71 furnished with a protruding link arm 73, a tool-carrier shaft 75, a motor 77 for rotating the tool-carrier shaft 75, and means 79 for actuating the tool-carrier shaft 75.

As illustrated in FIG. 2, the support 71 is of generally cylindrical shape. It is mounted rotatably on the grindstone support 22 about a horizontal pivot axis D–D', perpendicular to the first axis A–A'.

The tool-carrier shaft 75 is mounted rotatably about a third axis C–C' at the free end of the link arm 73. In the example illustrated in FIGS. 1 to 5, the tool-carrier shaft 75 remains in the vertical plane which passes through the first axis A–A'.

This shaft 75 supports a grindstone 81 for back-beveling, a grindstone 83 for grooving, and a bit 85 for drilling.

Figure 5:
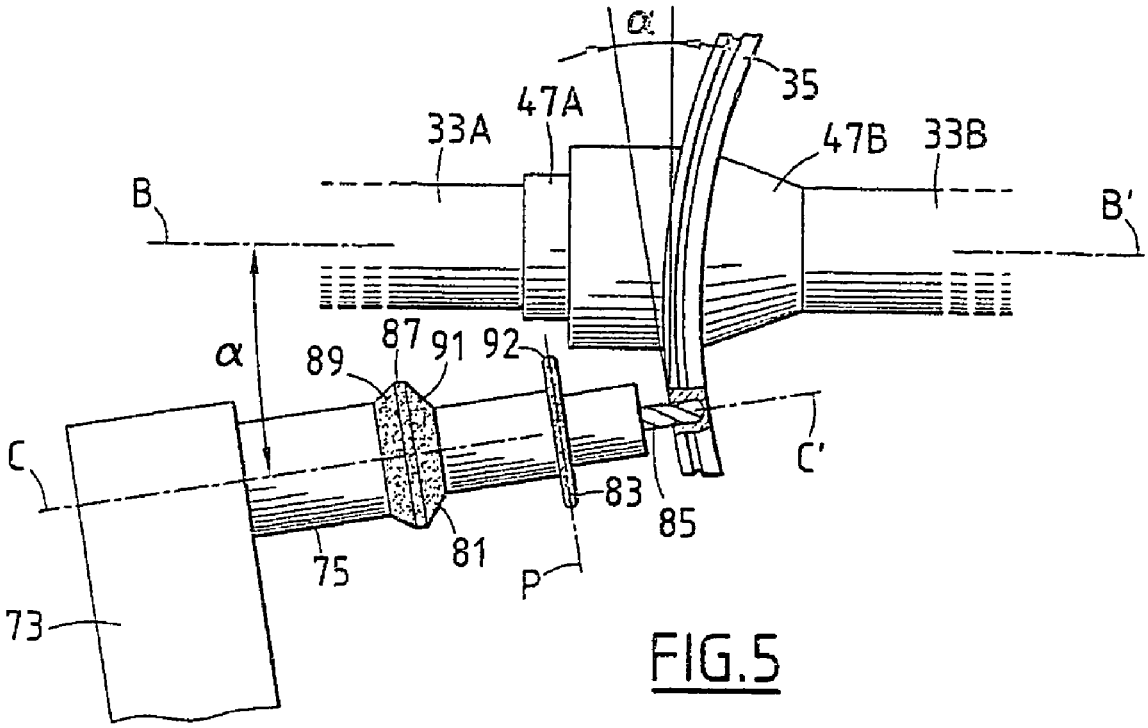
FIG. 5 is a detail view of FIG. 4.

The back-beveling grindstone 81 has a much smaller diameter than that of the grindstones 21A to 21D of the grindstone set. As illustrated in FIG. 5, this back-beveling grindstone has externally a cylindrical mid-surface 87, surrounded by two frustoconical surfaces 89 and 91 which converge as they move away from this surface. As illustrated in FIG. 5, it is a surface 89 having a half-cone angle at the top that is relatively small, for example of the order of 35°, and an opposite surface 91 having a half-cone angle at the top that is relatively large, for example 55°.

The grooving grindstone 83 comprises a single, narrow, cylindrical mid-surface 92. In the example illustrated in FIG. 5, the width of the cylindrical mid-surface lies between 0.5 and 1.6 mm.

The drill bit 85 is mounted at the free end of the tool-carrier shaft 75 and is aligned with the third axis C–C'.

The motor 77 for rotating the tool-carrier shaft 75 is connected to this shaft 75 by transmission means comprising in particular a pulley 93 and a belt 95 (FIG. 1).

The means 79 for actuating the tool-carrier shaft 75 comprise (FIG. 1) an actuating motor 101 whose output shaft 103 is furnished at its end with a worm 105. This worm 105 interacts with a tangential toothed wheel integral with the support 71.

These actuating means 79 rotate the support 71 about the pivot axis through an angular movement of at least 30°, and preferably 180°.

Consequently, during this rotary movement, the angle formed between the third axis C–C' and the first axis A–A' or the second axis B–B' varies by at least between 0 and 30° and preferably between 0 and 180°.

The control unit 19 is used to control, on the one hand, the movement of the grindstone support 22 in the axial direction and, on the other hand, the movement of the carriage 31 about the articulation shaft 43. Thus, this control unit 19 coordinates the relative movement of the lens support relative to the grindstone set. Furthermore, this control unit is furnished with synchronization means (not shown) used to control simultaneously the axial movement of the grindstone support 22 and the movement of the carriage 31 about the articulation shaft, according to a predefined control law.

As an example, a description of a grinding operation will now be given followed by an operation of drilling an ophthalmic lens blank using the grinding device of FIGS. 1 to 5.

Figure 3:
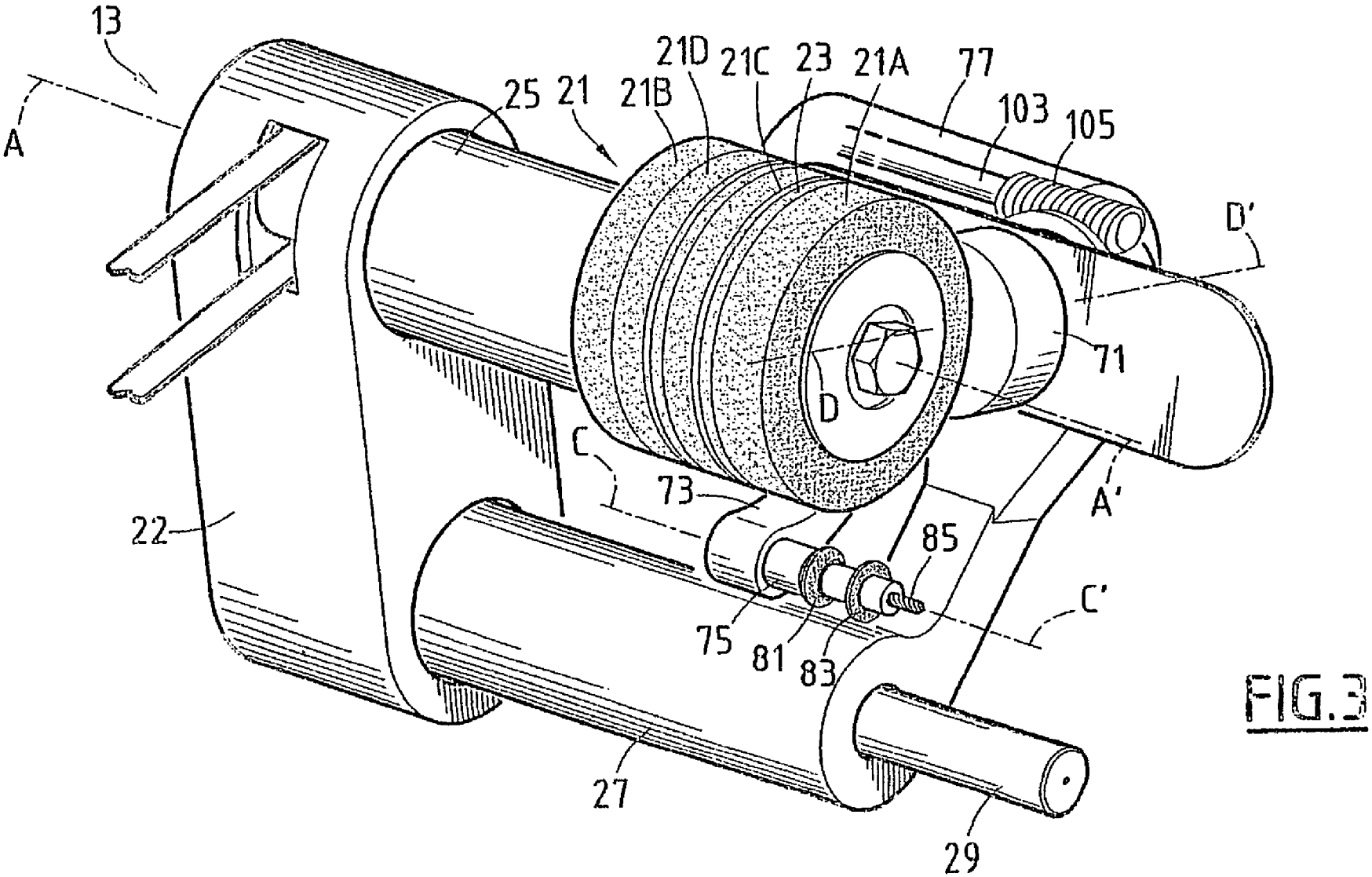
FIG. 3 is a view in perspective taken along the arrow III of FIG. 1 of a detail of the grinding machine according to the invention, with the tool-carrier assembly in the retracted position.

Initially and as illustrated in FIG. 3, the support 71 is oriented so that the arm 73 and the tool-carrier shaft 75 are in a retracted position beneath the grindstone set 21. Thus, the space situated above the grindstones 21A to 21D is totally clear.

As is known, the blank 35 is wedged between the two ends 47A and 47B of the half-shafts 33A and 33B by an adapter suitably positioned on the blank.

Consequently, the motor for rotating the grindstones 21A to 21D is activated. The grindstone set 21 is then rotated about the first axis A–A' by this motor. The control unit 19 controls the means of axial movement of the grindstone support 22 and the means of radial movement 39 of the carriage 31 to position the lens blank 35 in contact with the rough-cutting grindstone 21A.

The motor 37 for rotating the lens blank 35 relative to the second axis B–B' is then actuated to cause this blank 35 to rotate about this second axis B–B'.

Simultaneously, thanks to the mechanism 51, the distance between the first axis A–A' and the second axis B–B' is adjusted according to the angular position of the blank 35 about the second axis B–B', to suit the shape of the spectacle frame onto which the lens is to be mounted after it has been processed.

In the same manner, the lens is then brought to the grindstone for finishing with beveling 21C.

The blank then has its final contour. A drilling operation is then carried out.

In a first step, the grindstone support 22 is positioned at the end of axial travel. This end of travel corresponds to a position of the grindstone support 22 at the extreme right of FIG. 1. Simultaneously, the carriage 31 is moved away from the grindstone set 21 by upward movement of the guide rod 53 up to an end of radial travel.

The motor 101 for actuating the tool-carrier assembly 17 is then activated. The rotation of the output shaft 103 of this motor 101 rotates the worm 105 about an axis parallel to the first axis A–A'. This worm 105 interacts with the toothed wheel provided on the support 71. The support 71 is then rotated about its pivot axis D–D'. This rotary movement of the support 71 causes the tool-carrier shaft 75 to pivot about the pivot axis D–D' in the vertical plane passing through the axis A–A', from the retracted position shown in FIG. 3, situated beneath the grindstone set, to an active position shown in FIG. 4, situated above the grindstone set.

Based on the data received from the tracers 61, the control unit 19 determines the angle formed by the tangent to the outer or inner surface of the lens blank 35 at the drilling point of this blank 35 and the direction perpendicular to the second axis B–B' which passes through this drilling point. This angle is marked $\underline{\alpha}$ in FIG. 5. The angle $\alpha$ depends on the curvature of the lens blank 35.

The motor 101 for actuating the tool-carrier assembly 17 is deactivated when the angle formed by the third axis C–C' and the second axis B–B' is equal to this angle $\underline{\alpha}$.

The means for axial movement of the support 22 and the means for radial movement 51 of the carriage 31 are then controlled to bring the end of the bit 85 into contact with the drilling point (FIG. 4).

The bit 85 is then perpendicular to the outer surface of the lens blank 35, irrespective of the curvature of this blank.

The motor 77 for rotating the tool-carrier shaft 75 is then activated. The means for axial movement of the support and the means for radial movement 39 of the carriage 31 are then controlled by the means for synchronizing of the control unit 19 to move the tool-carrier shaft 75 in translation along the third axis C–C' while keeping the inclination of this third axis C–C' relative to the second axis B–B' constant and equal to α, throughout the whole drilling operation. More precisely, during the drilling, the support 22 moves leftward and the carriage 31 moves downward so that the drilling point moves exactly along the axis C–C'.

As a variant, the angle formed by the third axis C–C' and the second axis B–B' is controlled before a back-beveling operation so that the angle of attack between the surface of the back-beveling grindstone 81 and the sharp edge of the lens blank 35 to be ground is equal to a predetermined value irrespective of the curvature of this blank.

In another variant, the angle of inclination of the third axis C–C' relative to the second axis B–B' is controlled before a grooving operation so that the mid-plane P of the grooving grindstone 85 is for example parallel to the tangent to the convex surface of the lens blank at the sharp edge, or else parallel to a direction mid-way between the tangents of the convex and concave surfaces.

This makes it possible to obtain a high degree of uniformity of width of the groove over the whole periphery of the lens irrespective of the shape of the latter (curvatures and peripheral profile).

Thanks to the invention that has just been described, it is possible to have a machine which can be used at the same time to grind, back-bevel, groove and drill ophthalmic lens blanks of different curvatures, while maintaining the quality of these operations irrespective of the curvature of the lens blank.

This machine can be used to perform all these operations economically and effectively.

The invention claimed is:

1. A machine for grinding optical lenses, of the type comprising:

a grindstone set mounted rotatably about a first axis;

a lens support furnished with means for rotating the lens about a second axis which, at least during grinding, is substantially parallel to said first axis;

means for relative axial and radial positioning of the lens support relative to the grindstone set; and a tool-carrier assembly comprising at least one tool mounted integral with a tool-carrier shaft rotatable about a third axis, means for actuating the tool-carrier shaft suitable for moving the tool between a retracted position and an active position in the vicinity of said second axis, the third axis having an inclination that can be varied relative to the second axis, the tool-carrier assembly also comprising means for controlling, on a value dependent on the value of the curvature of the lens, the angle of inclination of the third axis relative to the second axis when the tool is distant from the lens, characterized in that the control means are suitable for retracting the tool-carrier shaft via the control of said angle of inclination.

2. The grinding machine as claimed in claim 1, further comprising means for relative movement of the tool-carrier shaft relative to the lens support in translation along the third axis when the tool is in the active position.

3. The grinding machine as claimed in claim 2, wherein said means for relative movement comprise means for relative translation of the tool-carrier shaft relative to the second axis in a first direction, particularly in a direction parallel to the second axis, means for relative pseudo-translation of the tool-carrier shaft relative to the second axis in a second direction distinct from the first direction, particularly a direction perpendicular to the second axis, and means for synchronizing said translation and pseudo-translation means.

4. The grinding machine as claimed in claim 2, wherein the grindstone set comprises a grindstone support furnished with means for axial translation, and in that the tool-carrier assembly is connected in translation to said grindstone support.

5. The grinding machine as claimed in claim 2, wherein the lens support is furnished with radial pseudo-translation means.

6. The grinding machine as claimed in claim 1, wherein the tool-carrier assembly is mounted rotatably on the grindstone support about an axis perpendicular to said first axis.

7. The grinding machine as claimed in claim 1, wherein said control means control the angle of inclination of the third axis relative to the second axis between 0 and 30° in the active position of said shaft.

8. The grinding machine as claimed claim 1, wherein said control means are suitable for retracting said shaft under the grindstone set by moving it in front of the latter.

9. The grinding machine as claimed in claim 1, wherein the at least one tool includes a back-beveling grindstone.

10. The grinding machine as claimed in claim 1, wherein the at least one tool includes a grooving grindstone.

11. The grinding machine as claimed in claim 1, wherein the at least one tool includes a drilling tool.

12. The grinding machine as claimed in claim 1, further comprising means for relative movement of the tool-carrier shaft relative to the lens support in translation along the third axis when the tool is in the active position, and in that said relative movement means comprise means for relative translation of the tool-carrier shaft relative to the second axis in a first direction, parallel to the second axis, means for pseudo-translation of the lens support relative to the second axis in a second direction perpendicular to the second axis, and means for synchronizing said means of translation and pseudo-translation.

13. The grinding machine as claimed in claim 3, wherein the grindstone set comprises a grindstone support furnished with means for axial translation, and in that the tool-carrier assembly is connected in translation to said grindstone support.

14. The grinding machine as claimed in claim 3, wherein the lens support is furnished with radial pseudo-translation means.

15. The grinding machine as claimed in claim 4, wherein the lens support is furnished with radial pseudo-translation means.

16. The grinding machine as claimed in claim 13, wherein the lens support is furnished with radial pseudo-translation means.

17. The grinding machine as claimed in claim 2, wherein the tool-carrier assembly is mounted rotatably on the grindstone support about an axis perpendicular to said first axis.

18. The grinding machine as claimed in claim 3, wherein the tool-carrier assembly is mounted rotatably on the grindstone support about an axis perpendicular to said first axis.

19. The grinding machine as claimed in claim 4, wherein the tool-carrier assembly is mounted rotatably on the grindstone support about an axis perpendicular to said first axis.

20. The grinding machine as claimed in claim 13, wherein the tool-carrier assembly is mounted rotatably on the grindstone support about an axis perpendicular to said first axis.

* * * * *